United States Patent [19]

Myers et al.

[11] 4,051,022

[45] Sept. 27, 1977

[54] SYNTHETIC OIL TREATMENT

[75] Inventors: Gary A. Myers, Plano; Donald K. Wunderlich, Richardson, both of Tex.

[73] Assignee: Atlantic Richfield Company, Los Angeles, Calif.

[21] Appl. No.: 597,297

[22] Filed: July 18, 1975

Related U.S. Application Data

[63] Continuation of Ser. No. 421,139, Dec. 3, 1973, abandoned, which is a continuation-in-part of Ser. No. 314,015, Dec. 11, 1972, abandoned.

[51] Int. Cl.[2] ..... C10G 29/04; C10G 25/00

[52] U.S. Cl. ..... 208/253; 208/91; 208/295; 208/297

[58] Field of Search ..... 423/138, 140; 208/11, 208/91, 217, 244, 215, 300, 304, 44, 88, 89, 251 R, 251 H, 253, 229, 295, 284

[56] References Cited

U.S. PATENT DOCUMENTS

| | | | |
|---|---|---|---|
| 2,639,982 | 5/1953 | Kalbach | 208/11 |
| 2,692,226 | 10/1954 | Smith | 208/11 |
| 2,769,770 | 3/1956 | Bicek | 208/68 |
| 2,779,715 | 1/1957 | Murray et al. | 208/284 |
| 3,069,350 | 12/1962 | Ramella | 208/89 |
| 3,496,099 | 2/1970 | Bridge | 208/251 H |
| 3,507,784 | 4/1970 | O'Hara | 208/253 |
| 3,712,861 | 1/1973 | Rosinski et al. | 208/251 H |
| 3,804,750 | 4/1974 | Meyers et al. | 208/253 |
| 3,876,533 | 4/1975 | Meyer | 208/251 |
| 3,896,049 | 7/1975 | Dworak | 252/466 V |
| 3,933,624 | 1/1976 | Meyer | 208/253 |

*Primary Examiner*—O. R. Vertiz
*Assistant Examiner*—Gary P. Straub
*Attorney, Agent, or Firm*—M. David Folzenlogen

[57] ABSTRACT

A method for removing at least one impurity selected from the group consisting of arsenic and selenium from a synthetic crude oil or a fraction thereof by employing iron or cobalt, nickel, oxides in a coprecipitated solid matrix with aluminum oxide, in a hydrogen atmosphere, at a temperature of at least 300° F, and in the substantial absence of water, whereby at least one of the arsenic and selenium is removed by way of iron or cobalt, oxide, or sulfide. Also disclosed is a method of preparation and use of a particularly preferred structural matrix in accordance with one embodiment of this invention.

3 Claims, No Drawings

SYNTHETIC OIL TREATMENT

CROSS-REFERENCES TO RELATED APPLICATIONS

This is a continuation application of copending U.S. application Ser. No. 421,139, filed Dec. 3, 1973; which application was copending with and a continuation-in-part application of U.S. application Ser. No. 314,015, filed Dec. 11, 1972. Both of the parent applications have now been abandoned in favor of this application.

BACKGROUND OF THE INVENTION

Heretofore, various metal oxides including iron, nickel, and cobalt oxides have been employed to remove arsenic from hydrocarbon charge stocks, such as naphtha or straight run gasoline, all obtained from naturally occurring crude oil. By employing the oxides at Low temperature such as from room temperature to 250° F, by disregarding the atmosphere under which the reaction takes place, and by using substantial amounts of water, the oxide acts as an oxidizing agent and oxidizes the arsenic to a water soluble arsenic oxide. In this way the arsenic oxide is dissolved in the water and removed from the hydrocarbonaceous liquid. This process is fully and completely disclosed in U.S. Pat. No. 2,778,779, the disclosure of which is incorporated herein by reference.

Also, heretofore, arsenic has been removed from similar naturally occurring hydrocarbonaceous liquids including crude oil by contacting the hydrocarbonaceous liquid with a metal salt of a strong acid at low temperatures such as room temperature and without regard to the atmosphere under which the contacting takes place. In this particular process it was taught that oxides do not work for removing arsenic. This process is fully and completely disclosed in U.S. Pat. No. 2,781,297, the disclosure of which is incorporated herein by reference.

Processes that work for removing other contaminants, or catalyst-poisoning materials, such as organometallic compounds like iron porphyrins, are frequently inoperable for removing impurities like arsenic. For example, the catalytic hydrogenation of hydrocarbons to effect precipitation of an insoluble iron salt of the iron porphyrins within a hydrogenating catalyst, as described in U.S. Pat. No. 3,496,099, cannot be employed satisfactorily in removing arsenic from synthetic crudes or the like.

In fact, none of the prior art processes have been completely satisfactory in removing catalyst-poisoning impurities, such as arsenic, from synthetic crude oil and synthetic oil fractions.

BRIEF DESCRIPTION OF THE INVENTION

In has now been discovered that at least one of arsenic and seleniun can be removed from a hydrocarbonaceous fluid (gas and/or liquid) feed which is not naturally occurring, (i.e., is not a naturally occurring crude oil or a fraction derived therefrom) but which is obtained from normally solid coal, oil shale, or tar (including tar sands). The feed for this invention can, therefore, be a synthetic crude oil or a fraction derived therefrom. The non-naturally occurring hydrocarbonaceous fluid is contacted with a material selected from the group consisting of iron, cobalt, nickel, oxides of one or more of those metals, sulfides of one or more of those metals, and combinations of two or more of said metals, oxides, and/or sulfide. The sulfide is advantageous in the forms other than the particularly preferred co-precipitated material, described hereinafter.

The above materials are employed on the feed under a hydrogen atmosphere and at an elevated temperature of at least 300° F, there being substantially no water present. By "substantially no water," or "substantial absence of water" is meant less than 1.0, preferably less than 0.1, percent by weight of water in the synthetic oil, or fluid to be treated. In this manner, the impurities are taken up by the material itself in a substantially water insoluble form.

In the discussion of this invention, reference to arsenic and selenium impurities is intended to include those impurities in the free or elemental form as well as those impurities in any combined form.

Accordingly, it is an object of this invention to provide a new and improved method for removing impurities from synthetic crude oil and synthetic oil fractions obtained therefrom. It is another object to provide a new and improved method for removing at least one of arsenic and selenium from synthetic fluids. Another object is to provide a new and improved method for purifying a synthetic fluid without employing water to absorb removed impurities. It is another object to provide a new and improved method for employing a solid material to remove impurities from synthetic fluid whereby the impurities removed are deposited on that solid material.

In specific embodiments, it is an object of this invention to provide and employ an economical, structurally strong, solid matrix that has a large surface area; that will remove impurities and effect diffusion of the impurities in its matrix structure and not merely concentrating impurities at its surface; and that retains its structural integrity even in the face of high concentrations of retained impurities.

Other aspects, objects and advantages of this invention will be apparent to those skilled in the art from this disclosure and the appended claims.

DETAILED DESCRIPTION OF THE INVENTION

According to the method of this invention arsenic, selenium, and combinations thereof, whether in elemental or combined form, are removed from a hydrocarbonaceous fluid feed that has been obtained by liquefying and/or gasifying each of normally solid coal, normally solid kerogen in oil shale, or the normally solid-like hydrocarbonaceous portions of tar or tar sands. The feed is contacted with at least one of the materials set forth hereinabove, the material being in a particulate form and preferably having a surface area of at least 1 square meter per gram, still more preferably at least 50 square meters per gram. The material can be employed by itself or in combination with a conventional support (carrier) such as silica, alumina, magnesia, zirconia, thoria, zinc oxide, chromium oxide, silicon carbide, naturally occurring carriers such as clays, kieselguhr, Fuller's earth, pumice, bauxite, and the like, and combinations of two or more thereof whether naturally occurring or prepared.

The material, whether supported or unsupported, can be in a particulate form to enhance intimate contacting of the material with the feed to be treated. The particle size distribution is not critical although the greater the external surface area the better from a point of view of completeness of contacting between the feed and the material. Generally, the material can be in a form such that at least about 50 weight percent thereof has a largest cross-sectional dimension (i.e., the diameter of a particle if it is round or the longest dimension through the center of a particle if it is not round) of no larger than about ½ inch. The material can be in any physical form including powders, pellets, granules, spheres, flakes, cylinders, and the like. Any amount of the material can be employed on a support.

Any amount of the material can be employed in the process of this invention, the more material that is present the better the removal of the impurity.

As regards the oxides and sulfides of the metals set forth hereinabove, the ferric, nickelic, cobaltic, ferrous, nickelous, and cobaltous forms can be employed. For example, ferric oxides, both $Fe_2O_3$ and $Fe_3O_4$, nickelic oxides, $Ni_2O_3$ and $Ni_3O_4$, and cobaltic oxides, $Co_2O_3$ and $Co_3O_4$, can be employed. Similar reasoning is applicable to the comparable sulfides of the metals and to the ferrous, cobaltous, and nickelous forms of the oxides and sulfides.

In a particularly preferred embodiment, an economical, structurally strong, solid matrix is effected by co-precipitating a mixture of the oxides of iron or cobalt and aluminum to obviate the disadvantages of the prior art and effect all of the objects delineated hereinbefore. Descriptive matter hereinafter delineates a method of forming and employing such a particularly preferred embodiment.

The feed is treated with the material of this invention, such as in a fixed bed reactor, at a temperature of at least 300° F, preferably at least 700° F, still more preferably from about 700° to about 800° F, under a hydrogen atmosphere, and for a time sufficient to achieve the desired degree of removal of impurity, generally at least about one minute. The desired atmosphere is preferably provided by molecular hydrogen being present with the feed as the feed contacts the subdivided material. Preferably, there is a hydrogen partial pressure present of at least 500 pounds per square inch gauge (psig), preferably at least 1,500 psig.

In a typical operation, the materials, in the form of pellets or other suitable particulate structure, are employed in a plurality of guard chambers, or protector vessels, upstream of the valuable bed of catalyst or like whose poisoning the materials are designed to protect. The materials in the first guard chamber are exposed to a predetermined amount of feed to be treated, based on empirical data. The feed is then routed to another guard chamber containing fresh material for treating the feed. If desired, an effluent stream of the treated feed can be monitored to maintain the concentration of the impurity below a predetermined level near zero; and the switching made as the concentration approaches the predetermined level. In any event, the spent material in the first guard chamber is removed after the stream is switched therefrom and fresh material emplaced in the first guard chamber as a replacement for the spent material. The cycle is then continued as necessary to effect the desired treatment.

The treatment may be batchwise or in a stream as long as the requisite residence time for contact and removal of the desired impurity is afforded. It has been found that for materials which are predominantly ferric oxide, 15 weight percent or more of the impurities can be removed and retained based on the weight of the ferric oxide. When higher amounts are retained on the ferric oxide, 20 to 25 percent by weight, however, flaking and spalling and large pressure drops across the guard chambers are likely to be encountered. Obviously, other specific percentages apply for other materials. While the mechanism that causes the flaking and spalling is not certain, the following mechanism is postulated as a theory only and for information only. It is not to be construed as limiting the method of this invention which is effective regardless of the correctness of any theory postulated. The ferric oxide in a structural matrix can be converted to a sulfide by replacement of the oxygen with sulfur, and the matrix retains good strength because the disruption is not too severe. If, however, arsenic replaces the oxygen or sulfur in a surface layer of the matrix, a disruption of the matrix occurs that it severe enough to cause spalling ad flaking after sufficiently high concentration of arsenic is effected in the surface lattice. Examination of specimens with electron microprobe scans after treatment of the feed and removal of the arsenic showed a high concentration of arsenic in the surface layer about 30 microns thick. With iron sulfide, an attendant low concentration of sulfur was found similarly in the same surface layer.

Reducing the size of the pellets employed helped to increase the amount of impurity that could be removed without the adverse flaking and increased the usefulness of this invention.

A particularly preferred embodiment is afforded, however, by employing an economical, structurally strong solid matrix effected by a co-precipitated material containing an oxide or oxides of aluminum as a carrier and an active material, such as cobalt and iron. A patent application filed even date herewith, Ser. No. 421,140, entitled "Method of Forming Co-Precipitated Material," inventor Dennis D. Dworak, assignor to the assignee of this application, described a method of preparing the co-precipitated material. The descriptive matter of that application is embodied herein by reference for its details. Briefly described, the co-precipitated material is prepared as follows. A water soluble salt of cobalt or iron and a water soluble salt of aluminum are dissolved in water to form respective solutions. It is particularly preferred to employ water soluble salts having anions that form by-products with ammonium cation that decompose with heat to avoid additional filtering and washing to remove the by-products. Typical of such salts are (cobaltic or ferric) (chloride or nitrate) and aluminum (chloride or nitrate). The nitrates have nine waters of hydration in association therewith. The respective solutions are mixed together. The resulting admixture of solutions is poured, while stirring, into a stoichiometric excess of an aqueous solution of a basic material, such as the hydroxide or carbonate, that will form insoluble salts of the aluminum and the iron or cobalt. The sodium and potassium cations can be employed in the basic material, but they form by-products with the chlorides and nitrates that require separate steps of washing and filtering for removal. The carbonates are slightly soluble. Accordingly, it is preferred to employ ammonium hydroxide as the basic solution, since the ammonium by-product can be removed by heating. The insoluble basic salts, such as the hydroxides of iron or cobalt and aluminum are formed as co-precipitates. The liquid is decanted and the co-precipitates collected by centrifuging. The co-precipitates are dried at slightly above the boiling point of water. When free of water, the co-precipitates in the preferred embodiment are heated to remove the ammonium by-products; the temperature being raised to approximately 325° F to decompose and remove the ammonium nitrate, or to about 655° F to sublime the ammonium chloride.

The dried co-precipitate is ground to a fine powder. The powder is mixed with water to form a thick slurry. The slurry is worked or kneaded to provide the necessary consistency for extrusion. After extrusion of the desired size and shape, the material, as in the form of pellets, is dried to remove the water and then calcined to achieve the necessary solid matrix material, hardness and surface area. The co-precipitate can be formed into the desired configuration in any other known manner such as by pelletizing, speroidizing, agglomeration, and the like.

The resulting material can then be employed in the method of this invention to contact the feed to be treated and to remove the arsenic and/or selenium impurity therefrom.

The relative proportions of the salts are chosen such that the carrier co-precipitate, such as the aluminum hydroxide, is in a proportion of at least 25 percent on a mol basis, in order to give adequate structural strength and integrity, the remainder being essentially active co-precipitate. On the other hand, no more than about 95 percent, on a mol basis, of the carrier co-precipitate is employed, since the active portion, e.g., ferric hydroxide or cobaltic hydroxide, of the final co-precipitate could require an inordinately large bed of final co-precipitated material to effect the desired quantitative removal of contaminant or an inordinately short change out period for that material. A useful proportion has been found to have the carrier present in a proportion of about 50 percent on a mol basis of the co-precipitated material in order to attain high structural integrity, yet have a high enough proportion of the active material that feasibly sized beds of co-precipitated material can be employed.

The final co-precipitated material has been examined by X-ray spectroscopy and the like to try to delineate the character of its lattice. The resulting crystallograms indicate the final form of a 50 mol percent aluminum hydroxide co-precipitate with ferric hydroxide to be $Fe_2Al_2O_6$. In order words, in the co-precipitated material it is no longer possible to delineate the specific structure of the iron oxide or the aluminum oxide in the matrix. It is believed that this is partly responsible for the unusually good characteristics of maintaining its structural integrity, as well as affording a pore distribution that allows access to all portions of the lattice by the contaminants in the liquids to be treated. When the aluminum and ferric oxides are proportioned as delineated, examination of specimens with electron microprobe scans after treatment of the synthetic crude to remove the arsenic has shown that while the arsenic is still distributed in a surface layer, the arsenic in this layer is substantially more diffuse, e.g., penetrates deeper into the matrix, thereby providing a substantially greater structural integrity.

Either before, after, or before and after a feed is contacted with the material above described for impurity removal, the feed can be treated in other known ways for removal of one or more of the above-identified impurities. The feed can be pretreated for partial removal of impurities before the feed is treated in accordance with this invention. After treatment of the feed is accordance with this invention, the feed can be further treated for cleanup removal of impurities if necessary.

One suitable method that can be practiced in conjunction with this invention is conventional caustic washing. For example, one way to carry out caustic washing is to contact a liquid feed with an aqueous solution of at least one alkali metal hydroxide such as sodium hydroxide and potassium hydroxide, the hydroxide or combination of hydroxides being present in an amount of from about one to about 20 weight percent based upon the total weight of the aqueous solution. The caustic solution is contacted with the hydrocarbonaceous liquid in a solution/liquid weight ratio of from about 1:1 to about 1:10, the contacting being carried out at a temperature of at least 200° F, preferably at least 300° F, with the pressure being maintained sufficient to prevent substantial vaporization of oil, e.g., at least about 300 psig. The atmosphere present during the contacting with caustic solution can be ambient, although if desired, neutral and/or reducing atmospheres can be employed but are not necessary. After treatment, the aqueous solution is separated from the hydrocarbonaceous liquid by conventional methods such as employing a settling tank followed by a centrifuge and the like. The hydrocarbonaceous liquid after treating with the caustic solution must be washed with water or other suitable solvent to remove residual caustic solutions and any impurities associated with that solution.

If an impurity separation process is employed prior to the method of this invention and that process employs water in some manner, substantially all of the water can be removed from the feed before carrying out the method of this invention. Removal of absolutely all the water is not necessary since the method of this invention is not deleteriously affected by the presence of water, but neither does the method of this invention require the presence of water to be operable or to act as a processing aid.

EXAMPLE I

In this example, a 400° to 800° F cut from shale oil which is obtained by retorting normally solid Colorado oil shale was contacted with ferric oxide in the form of $Fe_2O_3$ to reduce the 85 parts per million arsenic content in the shale oil feed.

The iron oxide material was prepared using FILTROL 120 beads which are round beads of approximately ⅛ inch diameter composed of approximately 50 weight percent naturally occurring clays and 50 weight percent alumina, and having a surface of 100 square meters per gram. The beads were impregnated with an aqueous ferrous sulfate solution, dried, and calcined at 1,000° F for 8 hours to convert the iron sulfate to ferric oxide. Reimpregnation with ferrous sulfate solution, drying, and calcining as above described was repeated once again. After the second calcining the beads contained 7.5 weight percent $Fe_2O_3$ based on the total weight of the beads.

To a one-inch diameter reactor tube, 50 grams of the above iron oxide beads were changed after which the reactor was pressured with molecular hydrogren to 2,000 psig and heated to 350° F. Thereafter, the above shale oil feed was charged to the reactor at the rate of 500 grams per hour (10 weight hourly space velocity), the temperature raised to 720° F, and a hydrogen flow rate established of 10 standard cubic feet per hour.

After 3.75 pounds of shale oil feed had passed through the reactor, a sample of the treated shale oil was taken, analyzed for arsenic by X-ray spectroscopy with triphenylarsine in mineral oil used for an arsenic standard, and showed an arsenic content of five parts per million thereby indicating a deposition on the iron oxide of 0.2 weight percent arsenic.

After 137 pounds of shale oil feed had passed through the reactor, another sample was taken and analyzed for arsenic in the same manner and showed 18 parts per million arsenic in the product shale oil. At this point there was on 8.9 weight percent deposition of arsenic on the iron oxide.

EXAMPLE II

Two and six-tenths grams of the crushed iron oxide beads described in Example I, the iron oxide having been used to remove arsenic from Colorado oil shale and containing 9 weight precent arsenic, were placed in 52.3 grams of deionized water containing no detectable arsenic. The water-iron oxide mixture was maintained at room temperature and ambient pressure with stirring for 1 hour. Thereafter, the water was analyzed for arsenic by X-ray spectroscopy using a commerically available arsenic in water standard and no arsenic was detected, thereby indicating an arsenic concentration in the water of less than the 10 parts per million lower detection limit of the X-ray spectroscopy analysis. If all the arsenic associated with the said beads had gone into the aqueous phase, the arsenic concentration in the aqueous phase would have been 4,500 parts per million.

This example together with Example I show that iron oxide under the operating conditions of Example I removed arsenic from the shale oil in a water insoluble form, the water insoluble form of the arsenic being deposited on the iron oxide material.

EXAMPLE III

The process of Example I was repeated except that the iron oxide beads were not used and in their place there was employed commerically available iron oxide shift catalyst pellets which are normally used for the conversion of carbon monoxide in hydrogen-rich streams to form additional quantities of hydrogen. The catalyst was in a form of tablets ⅜ inch in diameter by 3/16 inch long, having a surface area of 80 to 110 square meters per gram, and containing 87 to 91 weight percent $Fe_2O_3$, 7 to 11 weight percent $Cr_2O_3$, less than one weight percent $Al_2O_3$, 1.5 to 3 weight percent carbon as graphite and less than 0.05 weight percent sulfur. The shale oil feed, temperature, pressure and flow rates of shale oil and hyrogen remained the same as in EXAMPLE I.

After 5.5 pounds of shale oil feed containing 85 parts per million arsenic had passed through the reactor, a sample of the treated shale oil was obtained and analyzed for arsenic as in Example I, and contained 6 parts per million arsenic.

EXAMPLE IV

Example III was continued using the same catalyst and other process conditions except that the hydrogen pressure was reduced from 2,000 psig to 500 psig.

After 5.5 pounds of shale oil feed had passed through the reactor with the pressure at 500 psig, a sample of the treated shale oil was taken and analyzed for arsenic as in Example I, and showed an arsenic content at 7 parts per million.

This example shows that at a reduced pressure the method of this invention was still operable.

EXAMPLE V

This example is included to show a particularly preferred embodiment of this invention, including the method of preparation of a particularly preferred material for removing the impurity from the liquid to be treated; for example, removing arsenic from synthetic crude.

In this Example 70 grams of aluminum nitrate, $Al(NO_3)_3.9H_2O$, and 80 grams of iron nitrate, $Fe(NO_3)_3.9H_2O$, were dissolved in 300 milliliters of water. A solution of 160 milliliters of 58 percent ammonium hydroxide and 100 milliliters water was prepared in a 1,000 milliliter beaker. The respective solutions of aluminum nitrate and iron nitrate were poured into the ammonium hydroxide solution while stirring constantly. The insoluble hydroxides of iron and aluminum were formed as co-precipitates. The mixture, including the co-precipitates was centrifuged and the liquid decanted. The co-precipitates were dried at 230° F for 8 hours to be free of water. When free of water, the temperature was raised to 325° F for 8 hours to remove the ammonium nitrate. An advantage to using the nitrate salts is that heating removed most of the unwanted by-products without filtering and washing.

The resulting dry co-precipitates were ground in a bail mill for 10 minutes. This formed a fine powder that was of a size to pass through a 300 standard mesh screen. The fine powder was mixed with water until a thick slurry of a desired consistency for extrusion was obtained. The slurry was kneaded and worked to provide the desired consistency for extrusion. The slurry was then extruded through a die having a diameter of ⅛ inch.

The extrusions were dried at 230° F for 4 hour. The dried extrusions were than calcined at 1,050° F for 1 hour. The resulting extrusions had an internal surface area of approximately 160 square meters per gram. They formed a solid matrix that theoretically contained one mol of aluminum oxide per mol of iron oxide, but was indicated by X-ray spectroscopy to have the structure of $Al_2Fe_2O_6$ delineated hereinbefore.

The extrusions were employed as the material for removing the arsenic from the shale oil in runs duplicating Examples I–III, and the extrusions performed in a superior manner, absorbing the arsenic without spalling or flaking even when concentrations as high as 10 percent by weight of arsenic were retained by the solid matrix. Since the iron portion comprised only 50 percent of the matrix on a mol basis, this was equivalent to about 20 percent by weight based on the iron, a concentration at which flaking had been experienced before this particularly preferred embodiment was employed. Moreover, as indicated hereinbefore, electron microprobe scans of the specimens of the material after the arsenic had been dispersed in the matrix, indicated that the arsenic was diffused throughout a substantial portion of the material and not concentrated at the surface as previously experienced.

This example shows that the co-precipitation of the iron oxide with the aluminum oxide forms an economical, structurally strong material that retains its structural strength and integrity, has a large surface area for relatively large capacity for removal of the impurity and has relatively large passageways and pores distributed throughout the matrix to enable dispersion of the impurity in the matrix and resist the high concentration of impurities that results in the breaking down of the surface layers.

Reasonable variations and modifications are possible within the scope of this disclosure without departing from the spirit and the scope of this invention.

The embodiments of the invention in which an exclusive property or privilege is claimed are defined as follows:

1. A method for removing at least one non-metallic impurity selected from the group consisting of arsenic and selenium from a synthetic hydrocarbonaceous liquid obtained from normally solid coal, oil shale, or tar comprising contacting said liquid with a solid co-precipitated material consisting essentially of aluminum, oxygen, and a metal selected from the group consisting of iron and cobalt; said co-precipitated material being in subdivided form; and carrying out said contacting of said liquid and said co-precipitated material in a hydrogen atmosphere at a temperature of at 300° F and in the substantial absence of water, said substantial absence of water being less than 1.0 percent by weight of water in said liquid, and effecting deposition of said at least one non-metallic impurity on said co-precipitated material.

2. The method of claim 1 wherein said aluminum is present in a proportion within the range of from about 25 to about 95 percent, on a mol basis of said aluminum and said metal selected from the group consisting of iron and cobalt.

3. The method of claim 2 wherein said solid co-precipitated material consists essentially of $Al_2Fe_2O_6$.

* * * * *

UNITED STATES PATENT OFFICE

CERTIFICATE OF CORRECTION

Patent No. 4,051,022 Dated Sept. 27, 1977

Inventor(s) Gary A. Myers et al.

It is certified that error appears in the above-identified patent and that said Letters Patent are hereby corrected as shown below:

Column 1, line 19, "Low" should read ---low---.

Column 3, line 33, "800°F" should read ---850°F---;
line 45, after the word "or", add ---the---;
line 54, after the word "approaches", delete the word "the", and substitute therefor ---that---.

Column 4, line 15, after the word "that", delete the word "it", and substitute therefor ---is---, and after the word "spalling", delete "ad", and substitute therefor ---and---;
line 35, after the word "application", delete the word "described", and substitute therefor ---describes---.

Column 5, line 13, after the word "pelletizing,", delete "speroidizing", and substitute therefor ---spheroidizing---;
line 51, after the words "in the", delete "liquids", and substitute therefor ---liquid---;
line 66, after the word "feed", delete "is" and substitute therefor ---in---.

UNITED STATES PATENT OFFICE

CERTIFICATE OF CORRECTION

Patent No. 4,051,022 Dated Sept. 27, 1977

Inventor(s) Gary A. Myers et al.

It is certified that error appears in the above-identified patent and that said Letters Patent are hereby corrected as shown below:

Column 6, line 58, after the word "were", delete "changed", and substitute therefor ---charged---.

Column 7, line 8, after the word "was", delete "on", and substitute therefor ---an---;
line 49, after the word "and", delete "hyrogen", and substitute therefor ---hydrogen---;
line 65, after the word "content", delete "at", and substitute therefor ---of---.

Column 8, line 27, "bail" should read ---ball---.
line 36, after the number "4", delete "hour", and substitute therefor ---hours---.

Column 10, line 3, after the words "of at", add ---least---.

Signed and Sealed this

Twenty-third Day of May 1978

[SEAL]

Attest:

RUTH C. MASON
Attesting Officer

LUTRELLE F. PARKER
Acting Commissioner of Patents and Trademarks